US005342504A

United States Patent [19]

Hirano et al.

[11] Patent Number: 5,342,504

[45] Date of Patent: Aug. 30, 1994

[54] PALLADIUM-NICKEL ALLOY PLATING SOLUTION

[75] Inventors: Tomio Hirano; Masaaki Tsukamoto, both of Shizuoka, Japan

[73] Assignee: Yazaki Corporation, Tokyo, Japan

[21] Appl. No.: 30,869

[22] Filed: Mar. 11, 1993

[30] Foreign Application Priority Data

Mar. 30, 1992 [JP] Japan ..... 4-073731

[51] Int. Cl.[5] ..... C25D 3/56

[52] U.S. Cl. ..... 205/257; 205/255; 205/260

[58] Field of Search ..... 205/238, 255, 257, 259, 205/260

[56] References Cited

FOREIGN PATENT DOCUMENTS 63-111194 5/1988 Japan ..... C25D 3/50

1585391 8/1990 U.S.S.R. ..... C25D 3/56

*Primary Examiner*—John Niebling

*Assistant Examiner*—Edna Wong

*Attorney, Agent, or Firm*—Finnegan, Henderson, Farabow, Garrett & Dunner

[57] ABSTRACT

A novel palladium-nickel alloy plating solution provides a uniform electrodeposited film with excellent gloss at a high electric current density. A palladium-nickel alloy plating solution comprises a water-soluble palladium salt, a water-soluble nickel salt, ammonia, an ammonium salt, and 3-pyridinesulfonic acid, which are solved in water. Further additives may be added in the solution.

6 Claims, No Drawings

PALLADIUM-NICKEL ALLOY PLATING SOLUTION

BACKGROUND OF THE INVENTION

1. Field of the Invention

The present invention relates to a plating solution for electroplating of a palladium-nickel alloy that is excellent in gloss on electric parts, decorative articles, or the like.

2. Description of the Related Background Art

The plating of palladium-nickel alloy shows excellent gloss and excellent corrosion resistance, and, therefore, is frequently used for formation of electric contacts of connector or printed circuit boards as well as for various decorative articles.

For example, one palladium-nickel alloy plating solution is prepared by mixing a water-soluble palladium salt such as dichlorodiamminepalladium in an amount of Pd of 10–50 g/l, a water-soluble nickel salt such as nickel sulfate in an amount of Ni of 10–70 g/l, and 10–70 g/l of an ammonium salt such as ammonium sulfate for stabilization of ammonia with each other, and then by adding aqueous ammonia to adjust a pH to around neutral. This solution, however, has a range of electric current density that is too narrow to obtain a plating film having satisfactory glossiness, so that the productivity of plated products may not be high.

SUMMARY OF THE INVENTION

The present invention provides a novel palladium-nickel alloy plating solution which can provide a uniform electrodeposited film having an excellent gloss even at a high electric current density.

The object of the present invention can be achieved by a palladium-nickel alloy plating solution comprising a water-soluble palladium salt, a water-soluble nickel salt, ammonia, an ammonium salt, and 3-pyridinesulfonic acid, which are dissolved in water.

The water-soluble palladium salt used in the palladium-nickel alloy plating solution according to the present invention may be one selected from the group consisting of palladium salts such as palladium chloride, palladium sulfate, and the like, and of palladium complex salts such as dichlorodiamminepalladium. There is no specific restriction on the selection. The water-soluble nickel salt may be one selected from the group consisting of nickel chloride, nickel sulfate, nickel acetate, and double salts and complex salts thereof. There is no specific restriction on the selection.

3-pyridinesulfonic acid, which is added in the palladium-nickel alloy plating solution according to the present invention, is used in such an amount that the effect of addition can be recognized, normally in an amount of 1–10 g/l. Further, if desired, conventionally known additives such as a smoothing agent, a gloss agent, a stress reducing agent, a surfactant, and the like, can be added into the solution.

Electroplating using the palladium-nickel alloy plating solution according to the present invention rarely presents a defect such as a pit, which is likely to be present in an electrodeposited film at a high electric current density additionally, the present invention can provide uniform alloy plated products that are excellent in gloss, and can provide beautiful alloy plated products without cloud or haze and without color change at a low electric current density.

The palladium-nickel alloy plating solution according to the present invention can provide a uniform palladium-nickel alloy electrodeposited film with excellent gloss and without a defect in the broad range of electric current density, thereby permitting relaxation of electroplating conditions and enhancing the productivity while reducing the production cost of deposited products.

DESCRIPTION OF THE PREFERRED EMBODIMENTS

Examples

Added were 50 g/l of dichlorodiamminepalladium (25 g/l of Pd), 100 g/l of nickel sulfate (hexahydrate) (22 g/l of Ni), 50 g/l of ammonium sulfate, and 100 ml/l of 28% aqueous ammonia. Further, 5 g/l of 3-pyridinesulfonic acid was added to the mixture to thereby prepare a plating solution (pH 7.74).

Using the plating solution, electroplating of palladium-nickel alloy was conducted with a cathode of preliminarily electropolished brass plate of 6 cm×10 cm in variations of electric current density between 0.3 A/dm$^2$ and 25 A/dm$^2$ at 60° C. to obtain respective films of 2 μm, and electrodeposited films thus obtained were evaluated as to Pd contents (weight %), glossiness, and appearance. Surface observation was also carried out using a scanning electron microscope to obtain an average particle size of deposited crystal grains. The results of the tests are shown in Table 1.

Another plating solution (pH 7.5) was prepared the same composition as the above except that no 3-pyridinesulfonic acid was added. Plating of palladium-nickel alloy was conducted using this plating solution in the same manner as above. Electrodeposited films obtained therefrom were evaluated in the same manner as above. The evaluation results are shown in Table 2.

TABLE 1

Pd—Ni Alloy Plating Solution According to the Present Invention

| Electric current density (A/dm$^2$) | Pd contents (wt %) | Glossiness | Deposited crystal grain average size (μm) | Appearance |
|---|---|---|---|---|
| 0.3 | 72.13 | 280 | 0.9 | Specular gloss |
| 1.0 | 76.77 | 278 | 0.8 | Specular gloss |
| 2.0 | 73.22 | 269 | 0.7 | Specular gloss |
| 5.0 | 67.80 | 272 | 0.6 | Specular gloss |
| 10.0 | 68.55 | 286 | 0.4 | Specular gloss |
| 15.0 | 65.70 | 274 | 0.35 | Specular gloss |
| 20.0 | 60.68 | 277 | 0.30 | Specular gloss |
| 25.0 | 56.31 | 281 | 0.25 | Specular gloss |

TABLE 2

Comparative Pd—Ni Alloy Plating Solution

| Electric current density (A/dm$^2$) | Pd contents (wt %) | Glossiness | Deposited crystal grain average size (μm) | Appearance |
|---|---|---|---|---|
| 0.3 | 63.15 | 38 | Unmeasurable | Black burnt |
| 1.0 | 67.66 | 17 | Unmeasurable | Black burnt |
| 2.0 | 71.75 | 98 | 1.5 | Cloud |
| 5.0 | 64.68 | 274 | 1.2 | Specular gloss |
| 10.0 | 65.23 | 272 | 0.9 | Specular gloss |
| 15.0 | 64.03 | 267 | 0.7 | Specular gloss |
| 20.0 | 63.80 | 279 | 0.5 | Specular gloss |
| 25.0 | 58.63 | 118 | 1.2 | Cloud |

As seen in the results, the palladium-nickel alloy electrodeposited films obtained by using the palladium-nickel alloy plating solution according to the present invention with 3-pyridinesulfonic acid have excellent properties in a broad range of electric current densities.

Many modifications may be made to adapt a particular situation or material to the teachings of the invention without departing from the essential scope thereof.

What is claimed is:

1. A palladium-nickel alloy plating solution comprising a water-soluble palladium salt, a water-soluble nickel salt, ammonia and an ammonia salt in combination with 3-pyridine sulfonic acid, these ingredients being dissolved in water, whereby a palladium-nickel alloy with improved quality can be obtained in a broad range of electric densities.

2. A palladium-nickel alloy plating solution according to claim 1, wherein said water-soluble palladium salt is a palladium salt selected from the group consisting of palladium chloride and palladium sulfate.

3. A palladium-nickel alloy plating solution according to claim 1, wherein said water-soluble palladium salt is dichlorodiamminepalladium.

4. A palladium-nickel alloy plating solution according to claim 1, wherein said water-soluble nickel salt is one selected from the group consisting of nickel chloride, nickel sulfate, nickel acetate, and double salts and complex salts thereof.

5. A palladium-nickel alloy plating solution according to claim 1, wherein 3-pyridinesulfonic acid is used in an amount of 1–10 g/l.

6. A palladium-nickel alloy plating solution according to claim 1, wherein an additive selected from the group consisting of a smoothing agent, a gloss agent, a stress reducing agent, and a surfactant is contained.

* * * * *

UNITED STATES PATENT AND TRADEMARK OFFICE

CERTIFICATE OF CORRECTION

PATENT NO. : 5,342,504

DATED : August 30, 1994

INVENTOR(S) : Tomio HIRANO et al

It is certified that error appears in the above-indentified patent and that said Letters Patent is hereby corrected as shown below:

Abstract, line 7, "solved" should read --dissolved--.

Signed and Sealed this

Twenty-fifth Day of April, 1995

*Attest:*

BRUCE LEHMAN

*Attesting Officer*

*Commissioner of Patents and Trademarks*